US011814270B2

(12) United States Patent
Huang

(10) Patent No.: US 11,814,270 B2
(45) Date of Patent: Nov. 14, 2023

(54) POWER WINCH WITH CHANGEABLE CONNECTION POSITION

(71) Applicant: Comeup Industries Inc., New Taipei (TW)

(72) Inventor: Shih Jyi Huang, New Taipei (TW)

(73) Assignee: Comeup Industries Inc., New Taipei (TW)

( * ) Notice: Subject to any disclaimer, the term of this patent is extended or adjusted under 35 U.S.C. 154(b) by 499 days.

(21) Appl. No.: 17/189,491

(22) Filed: Mar. 2, 2021

(65) Prior Publication Data

US 2022/0281725 A1 Sep. 8, 2022

(51) Int. Cl.
*B66D 1/48* (2006.01)

(52) U.S. Cl.
CPC ..... *B66D 1/485* (2013.01); *B66D 2700/0183* (2013.01)

(58) Field of Classification Search
CPC .. B66D 1/485; B66D 2700/0183; B66D 1/12; B66D 1/40; B66D 1/00
See application file for complete search history.

(56) References Cited

U.S. PATENT DOCUMENTS

2003/0021662 A1* 1/2003 Ramsey ..... B62D 43/045 414/463
2008/0001132 A1* 1/2008 Huang ..... B66D 1/12 254/362
2018/0201488 A1* 7/2018 Zheng ..... B66D 1/28

* cited by examiner

*Primary Examiner* — Michael C Zarroli

(57) ABSTRACT

A power winch with changeable connection position includes a first connection line and an induction line connected between a power source and an electric control box, which are connected to a second connection line for grounding the electric control box, and a third connection line is connected to the power source for grounding. These lines are connected to the exterior of the electric control box and the power source to facilitate a quick detachment from the electric control box and the power source.

7 Claims, 9 Drawing Sheets

POWER WINCH WITH CHANGEABLE CONNECTION POSITION

BACKGROUND OF THE INVENTION

Field of the Invention

The present invention relates to a power winch, and more particularly to a power winch capable of completing an electric connection quickly when the installation positions of an electric control box and a power source are changed, while maintaining good water resistance and safety to provide a wide scope of applicability.

Description of the Related Art

Power winch is a power tool used to hang and move a load up and down or drag the load to a nearer or farther position. In a common example, a hoist installed at a tall building for hoisting and vertically elevating heavy loads or goods is a power winch, or a rope hoist installed onto a jeep or an off-road vehicle for towing other vehicles for self-rescue (or escape) rope is also a power winch. In the operating principle of the power winch, a power source (such as a power motor or an electric motor) outputs a power to control and change the transmission in a forward direction or a reverse direction. After a deceleration mechanism is operated, a rope wheel is driven to perform a forward rotation or a reverse rotation to release or retract a rope (including but not limited a wire rope or a synthetic rope), and a front end of the rope (wire rope or synthetic rope) has a hoist hook for hooking a load (such as a heavy object, another car, or another object, etc.) in order to move the load. Since the deceleration mechanism must accept the transmission of the power source and the rope wheel must accept the transmission of the deceleration mechanism, and the rope must be wound on the rope wheel, therefore the power source, the deceleration mechanism, the rope wheel and the rope are coupled together by a support frame to form a "winch host". When the winch host is moved, the power source, the deceleration mechanism, the rope wheel, and the rope and the support frame are moved altogether, and when winch host is installed, the power source, the deceleration mechanism, the rope wheel, the rope and the support frame are locked together to a selected position.

At present, the power winch is mainly operated in a remote mode, so that the power winch must be equipped with an electric control box and a remote control, and the electric control box is electrically coupled to the power source of the winch host and the remote control, and the transmission of signals between the remote control and the electric control box may be performed in a wireless remote control mode or a cable remote control mode selectively. The electric control box mainly receives a control signal transmitted from the remote control and further controls the ON/OFF of the power source and control a rotating direction and a rotation speed for outputting the force of the power source. To facilitate operators to know the overall conditions of the power winch, a display panel (or display screen) is generally installed in front of the front of the electric control box or on a slight slop and the display panel is mainly provided for displaying the operating status and related information of the power winch, such as a power-on display (indicating the power source in a conducting status), a power level display (indicating the power level of a power source connected to a car), a temperature warning display (showing the temperature of the power source), a rope direction display (showing a release or retraction of a rope) and a wireless operation display (indicating a connection with a wireless remote control), etc.

Therefore, it can be seen that the conventional power winch is comprised of a winch host, an electric control box and a remote control. To facilitate operators to observe the display panel, the electric control box is usually installed at the top of the power winch. In other words, safety is most essential in the mind of manufacturers, so that the electric control box is configured to be combined with the winch host. What is more, the power winch installed to a car is generally used outdoors and in a field. In order to avoid the risk of having water or electricity leakage, a connection line (including an electrical control line and an induction line) between the electric control box and the winch host is concealedly-installed inside the outer cover wall, so that users cannot find the connection line from the appearance of the power winch. In addition to the purpose of avoiding the risk of water and electricity leakage, the concealedly-installed connection lines can prevent users from disassembling or changing components on their own that leads to a concern of safety.

In the conventional power winch, manufacturers have already consolidated the electric control box and the winch host together, so that after a user has bought a power winch, the user can only install (lock) the power winch onto a car for use. The early power winch was mostly installed (locked) at the bottom of the front of the car, so that it was fixed on the top of the front of the chassis or fixed to the front bumper. Later, the manufacturers developed the power winch to be installed (locked) on the bottom of the rear of the car, so that it can be fixed to the top of the rear of the chassis or fixed to the rear bumper. However, whether the power winch is installed at the bottom of the front of the car or the bottom of the rear of the car, the display panel must be exposed appropriately for viewing. When a user wants to use the power winch, the user takes out the remote control (usually placed in the car for backup) and runs to the front or rear of the car to unhook the hoist hook which is originally hooked to avoid impact, so as to pull the rope to the place where the user needs to hook the car, people or object, and then the operator holding the remote control can control the rope wheel to retract the rope by the remote control in order to pull back the hooked car, people or object. While the operator is operating and controlling the remote control, the operator, it is still necessary to watch the display panel on the electric control box frequently in order to know about the operating status and related information of the power winch, such as the power-on status of the power source, the power level of the car, the too-high temperature of the power source temperature, the correct or wrong releasing/retracting direction, and the connection/disconnection of remote signals, etc. in order to suspend the action when needed or change to a different car for rescue.

Since the cars that will install the power winch are mostly jeeps or off-road vehicles, and these kinds of cars have more spaces therefore the manufacturers have developed the power winch with an installation of at least one battery for the use of the power winch. In other words, the power winch does not use the electric power of the original battery of the car, but it just uses the electric power of the at least one battery installed at an appropriate position of the rear of the car, and such arrangement can avoid the embarrassment of running out of the original battery of the car and causing the car unable to start.

With the evolution and advancement of global technologies, as well as the growth of industrial knowledge and skills, the use of objects is often self-expanded or changed. As to the use of the power winch, the manufacturers and users gradually find out that the conventional assembly mode of consolidating the electric control box and winch host has some inconvenience is use, and the manufacturers mainly believe that it is not necessary to consolidate the electric control box and the winch host together for use, but the manufacturers attempt to install the electric control box inside the car for use (in order to keep the electric control box warm) in a cold area or install the electric box to a side of the car (in order to resist wind), so that the manufacturers come up with a design of allowing the electric control box and the winch host to be detached and keeping the winch host to be installed to the original position (which is the bottom of the front of the car or the bottom of the rear of the car), and the installation position of the electric control box is changed to the interior of the cockpit (such as being locked to the front of the cockpit) or the exterior of the cockpit (such as being locked onto the outer surface of the car body), and a connection line with an appropriate length is bought and used for electrically connecting the electric control box and the winch host. However, after changing different installation positions by oneself, the original concealed connection is ruined frequently, resulting in a poor water resistance, and giving rise to safety concerns of electric shock and fire.

SUMMARY OF THE INVENTION

In view of the aforementioned drawbacks of the conventional power winch, the inventor of the present invention has an idea to base on the conventional power winch to create a novel power winch capable of electrically connecting the electric control box and the power source quickly when the users change the installation positions of the two while taking the water resistance and safety into account, so as to provide a broader scope of applicability of the power winch.

Therefore, it is a primary objective of the present invention to provide a power winch with changeable connection position that can electrically connect the electric control box and the power source quickly when the users change the installation positions of the two while taking the water resistance and safety into account, so as to provide a broader scope of applicability of the power winch.

To achieve the above-mentioned objective, the present invention provide a power winch with changeable connection position, comprising a power source capable of driving a rope wheel to rotate the power winch in a forward rotation or a reverse rotation to release or retract a rope after the power source outputs a power transmission to a reduction gear; and an electric control box electrically coupled to the power source for controlling the ON/OFF of the power source and the rotating direction for an output force of the power source; characterized in that the electric control box comprises a plurality of waterproof power connection rods protruding from a side thereof, and an inner section of the power connection rods inside the electric control box is electrically coupled to an external electric power, and a protruding outer section of the power connection rods is exposed from a side of the electric control box; a plurality of first connection lines, with a quantity equal to the quantity of the power connection rods, and an end of the first connection line is coupled to the respective power connection rod; a plurality of waterproof protruding power connection rods formed on the power source and having a quantity equal to the quantity of the first connection lines, and an inner section of the power connection rod of the power source being electrically coupled to the interior of the power source, and an outer protruding section of the power source being exposed from the power source, and the other end of the first connection line being coupled to the respective power connection rod of the power source.

According to the above-mentioned power winch with changeable connection position, the power connection rods protrudes from a side of the electric control box come with a quantity of three.

According to the above-mentioned power winch with changeable connection position, the electric control box comprises a plurality of locking holes formed on a side thereof; a first outer cover, having an open inner side, a plurality of hole columns with quantity and position corresponding to those of the locking hole, and a through slot formed on the front side of the first outer cover, and the first outer cover covers the range of the power connection rods by the open inner side, and the first connection line is extended out from the through slot, and then a locking member is passed through the hole column from the outside and then locked to the locking hole, and the first outer cover is mounted onto a side of the electric control box to cover the power connection rods.

According to the above-mentioned power winch with changeable connection position, the power connection rods of the power source are arranged and partitioned to form a protruding edge around the power connection rods, and the protruding edge has two locking holes downwardly formed thereon; and the power winch further comprises a second outer cover configured to be corresponsive to the protruding edge and having a marginal wall formed inside the second outer cover and provided for partition, a through slot formed on the front side of the second outer cover, a hole column formed on a rear side of the second outer cover and configured to be corresponsive to the locking hole of the protruding edge and the second outer cover covers the protruding edge from top to bottom, and the marginal wall partitions the power connection rods of the power source, and the first connection line is passed out from the through slot, and a locking member is passed through the hole column of the second outer cover from top to bottom and then locked to the locking hole of the second outer cover, and the second outer cover is mounted onto the power source to cover the power connection rods of the power source.

According to the above-mentioned power winch with changeable connection position, one power connection rod is protruded and extended from the front of the electric control box, and the power winch further has a second connection line with an end coupled to the power connection rod protruded and extended from the front of the electric control box, and the other end of the second connection line is coupled to a positive electrode of the electric power.

According to the above-mentioned power winch with changeable connection position, one connecting rod is protruded and extended from the front of the electric control box, and the power winch further has an induction line with both ends coupled to the connecting rod protruded and extended from the front of the electric control box and the connecting rod protruded and extended from the front side of the power source respectively.

According to the above-mentioned power winch with changeable connection position, one power connection rod is protruded and extended from the front side of the power source, and the power winch further has a third connection line with an end coupled to the power connection rod protruded and extended from the front side of the power source, and the other end of the third connection line is coupled to a negative electrode of the electric power.

DETAILED DESCRIPTION OF THE PREFERRED EMBODIMENTS

The objectives, technical measures and effects of the present invention will become clearer in light of the following detailed description of an illustrative embodiment of this invention described in connection with the drawings.

Figure 1:
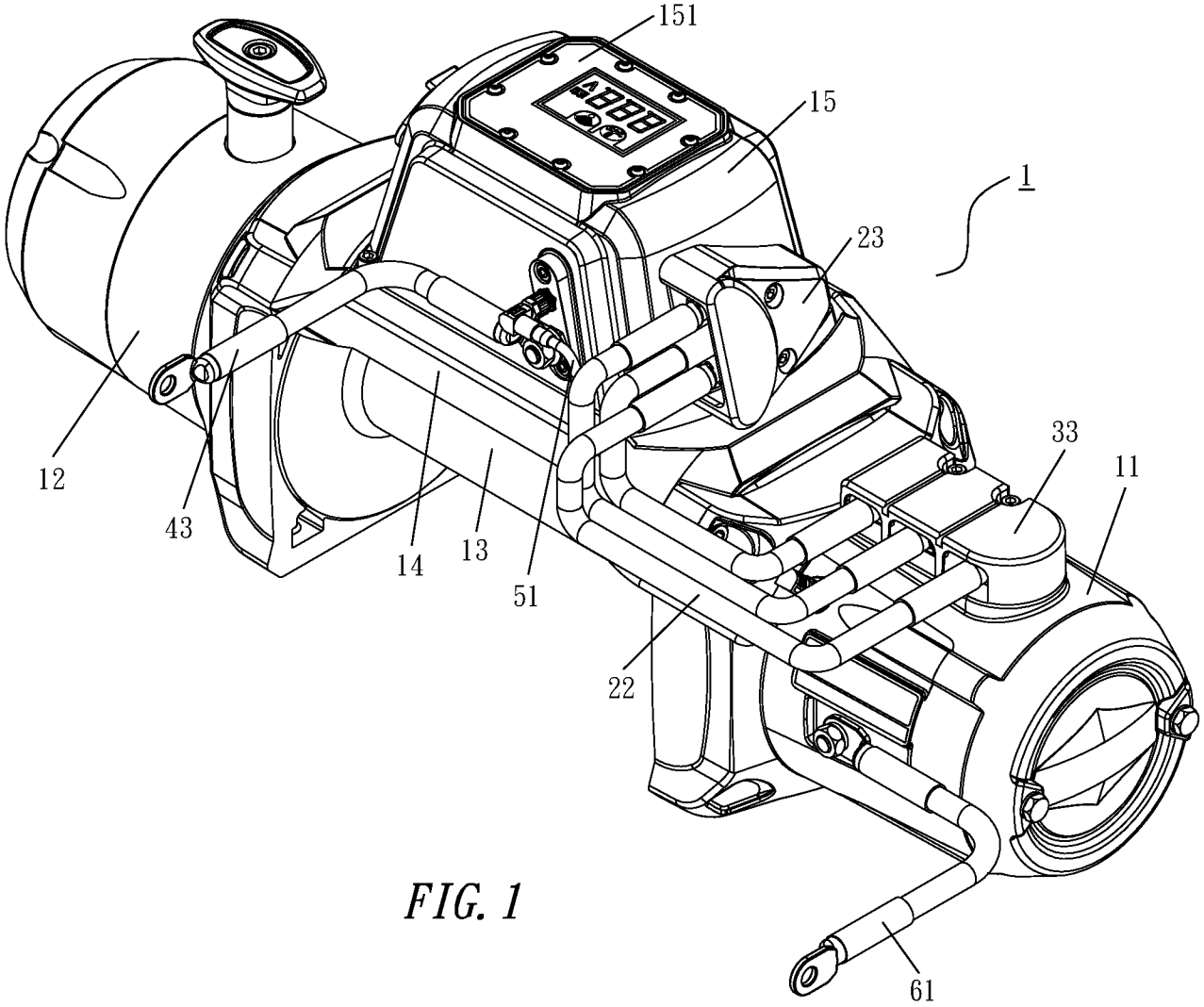
FIG. 1 is a perspective view of the present invention.
Figure 2:
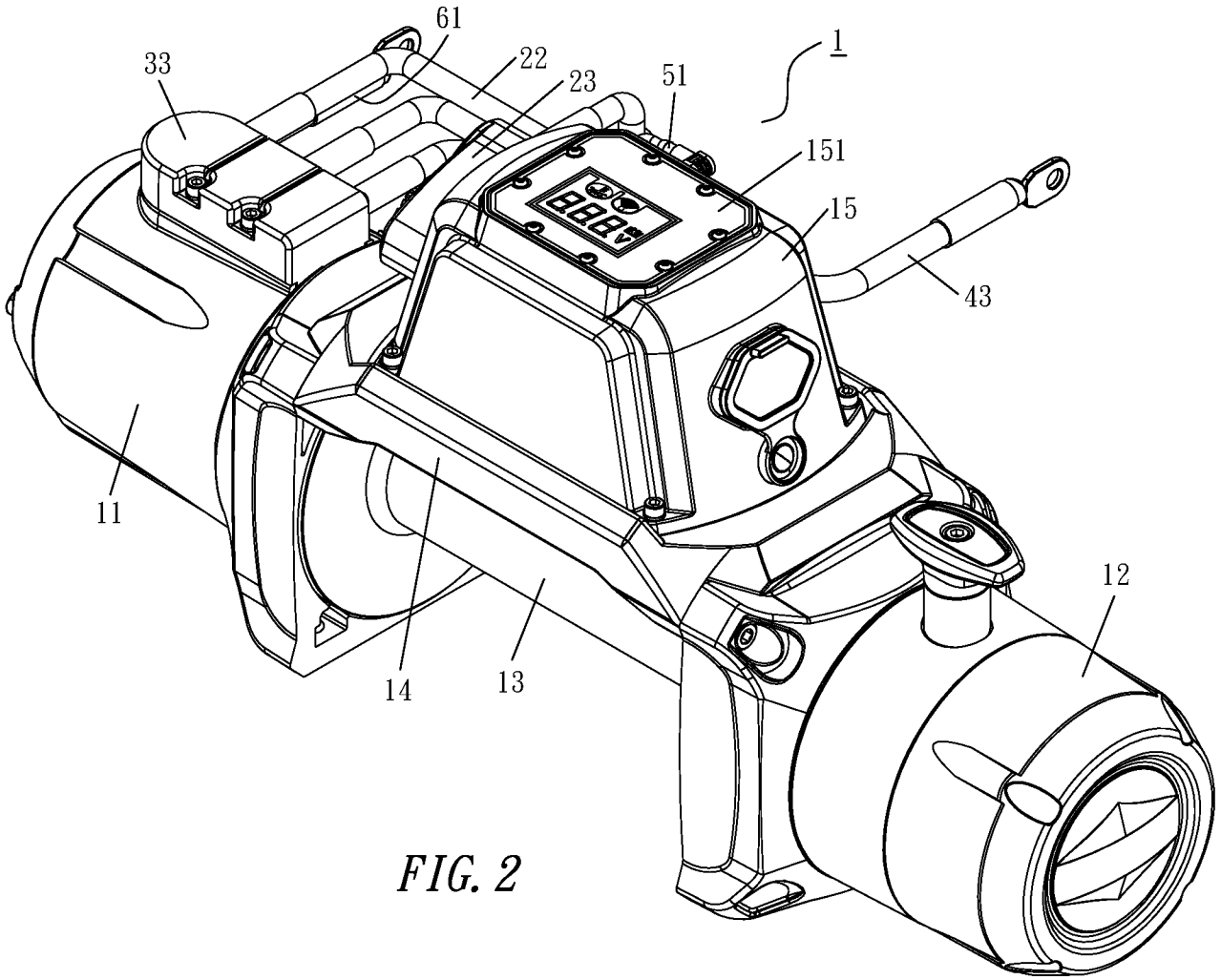
FIG. 2 is a perspective view of the present invention, viewing from another angle.
Figure 3:
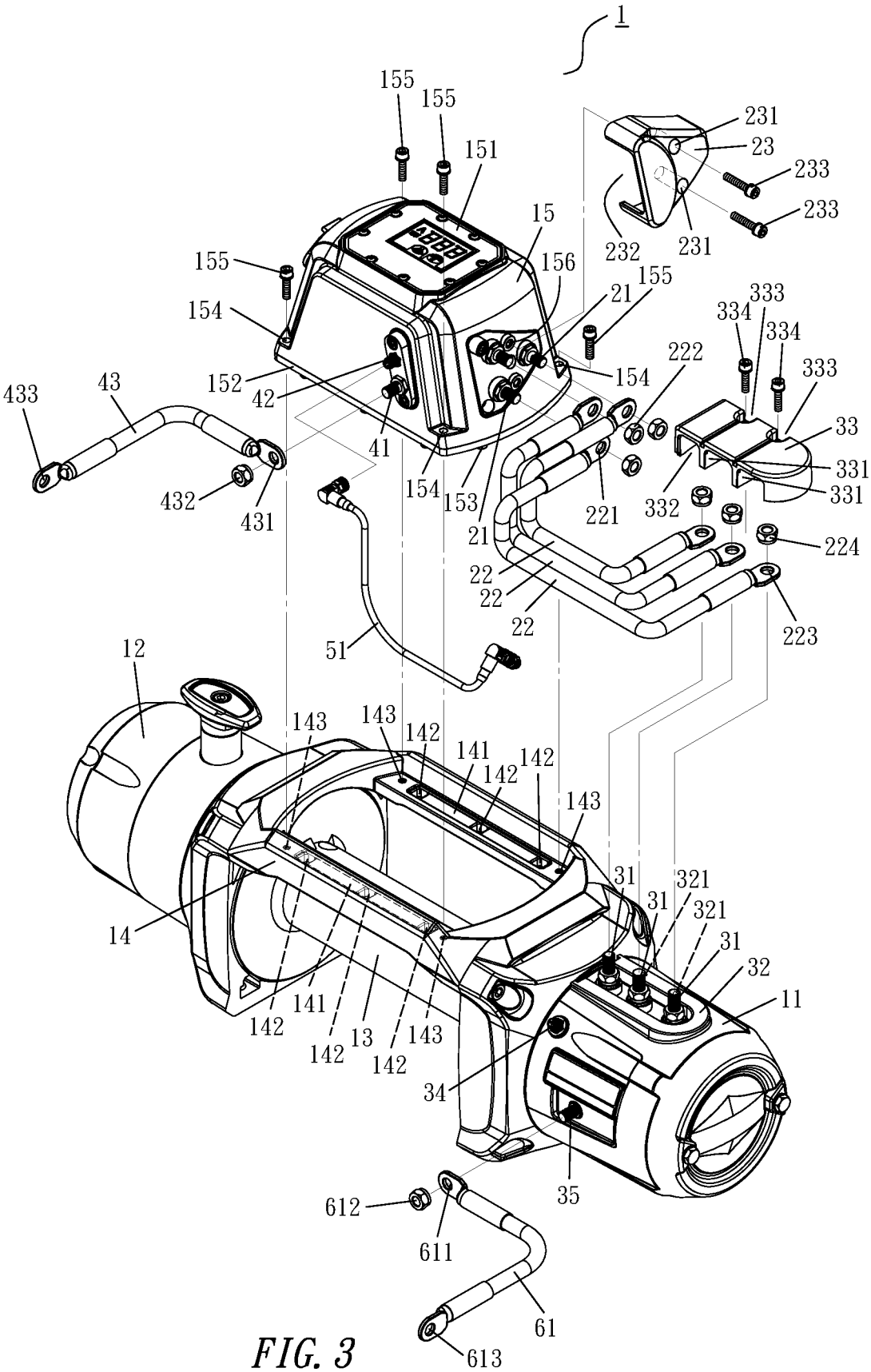
FIG. 3 is a first exploded view showing the major parts of the present invention.
Figure 4:
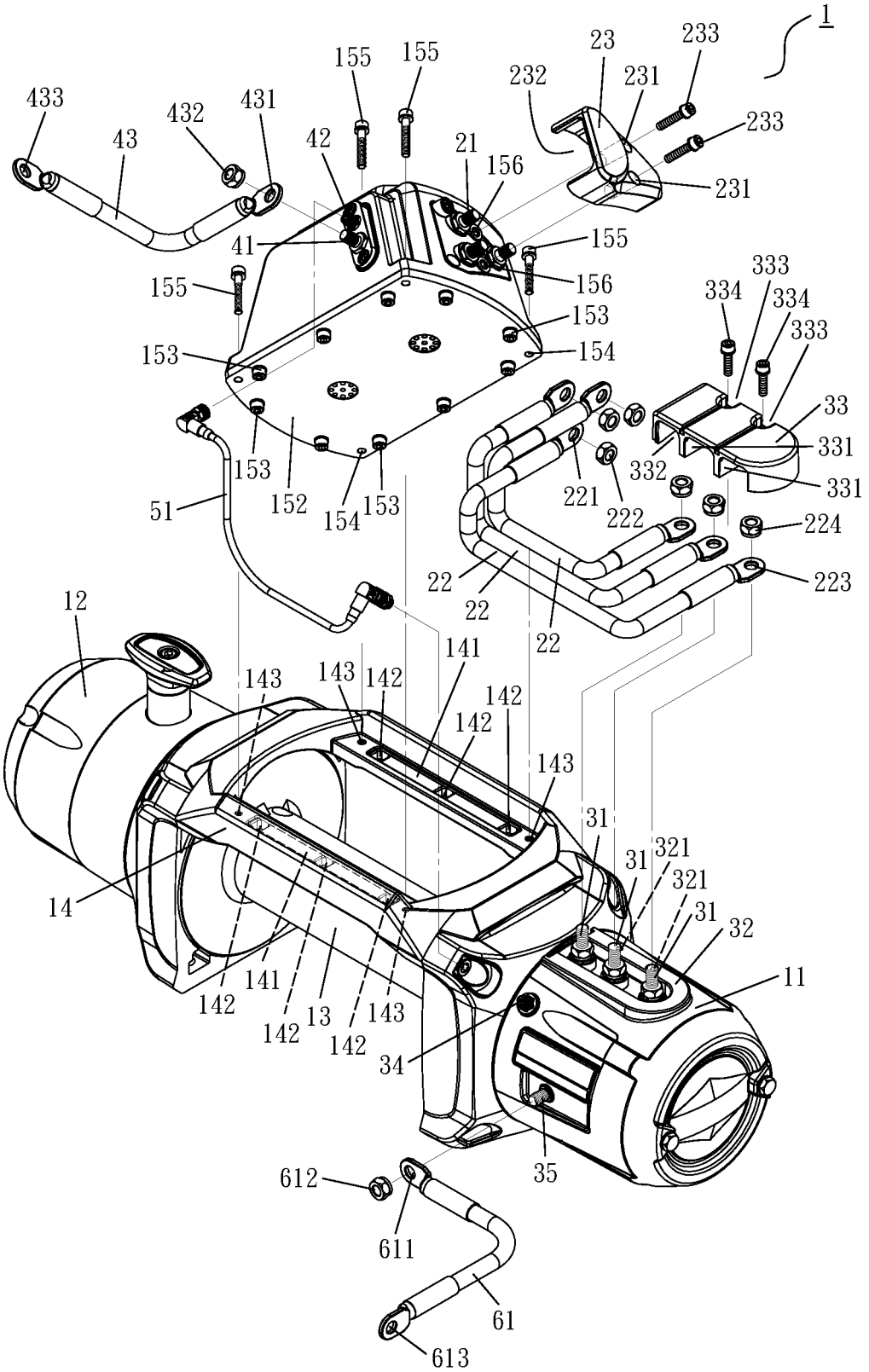
FIG. 4 is a second exploded view showing the major parts of the present invention.

With reference to FIGS. 1 and 2 for a power winch 1 in accordance with a first embodiment of the present invention, the power winch 1 includes a power source 11 (such as a power motor, a power DC motor, etc.), the power source 11 outputs a power transmission to a reduction gear 12 to drive a rope wheel 13 to rotate in a forward rotation or a reverse rotation in order to release or retract a rope when needed. For simplicity, the rope is not shown in the figures. With reference to FIGS. 3 and 4, the rope wheel 13 is disposed at the transverse central position of a support frame 14, and the power source 11 is mounted on one of the sides of the support frame 14, and the reduction gear 12 is mounted on the other opposite side of the support frame 14, a power transmission between the power source 11 and the reduction gear 12 passes through the inside of a barrel shaft of the rope wheel 13 in a non-contact manner, and then the reduction gear 12 substantially drives the rope wheel 13 to rotate, and the rope wheel 13 and the support frame 14 are coupled with each other by a bearing to achieve the effect of keeping the support frame 14 to remain still stably when the rope wheel 13 is rotated, and the power source 11, the reduction gear 12, the rope wheel 13, the rope and the support frame 14 form a "winch host".

In FIGS. 3 and 4, the top of the support frame 14 is open, and both of the front and rear of the interior of the support frame 14 separately have a support strip 141 with a plurality of accommodating cavities 142 formed thereon and spaced from one another and an engaging hole 143 formed on both sides. The power winch 1 includes an electric control box 15, a waterproof display panel 151 installed on the top of the electric control box 15, an electrical component with an electrical control effect (not shown in the figure) installed in the internal space of the electric control box 15, a waterproof bottom plate 152 attached to the bottom of the electric control box 15, a plurality of locking members 153 passing through the bottom plate 152 from top to bottom and then securely locked to a wall of the electric control box 15 with a waterproof effect, and a plurality of hole slots 154 formed between the electric control box 15 and the periphery of the bottom plate 152, so that when the electric control box 15 is placed on the support strips 141 on both sides of the open interior of the top of the support frame 14, each locking head of the locking members 153 on both sides of the bottom of the electric control box 15 is pressed and stayed into the respective accommodating cavity 142 in a one to one manner, while the hole slots 154 at the periphery of the electric control box 15 are in a one-to-one correspondence with the engaging holes 143. In this way, a locking member 155 can be passed through the respective hole slot 154 from top to bottom, and then locked with the respective engaging hole 143, and thus the electric control box 15 is fixed onto the top of the support frame 14, and the display panel 151 is exposed from the top (as shown in FIGS. 1 and 2).

In FIGS. 3 and 4, the electric control box 15 has a plurality of waterproof power connection rods 21 (such as three power connection rods in this embodiment) protruding from a side adjacent to the power source 11, and an inner section of each power connection rod 21 is electrically coupled to the interior of the electric control box 15 and an external electric power (such as a car battery or an additional battery), and the protruding outer section is exposed from a side of the electric control box 15, and the electric control box 15 includes a plurality of locking holes 156 formed on a side thereof, a plurality of first connection lines 22 (such as three first connection lines) with a non-restricted length and having a plurality of sleeve holes 221 formed at an end of the first connection line 22 and sheathed on the power connection rods 21 respectively in a one-to-one correspondence, and a nut 222 provided for screwing and connecting the power connection rod 21, wherein till the sleeve hole 221 is locked securely, the electric power can be conducted to the first connection line 22; a first outer cover 23, having an open inner side, a plurality of hole columns 231 formed therein with quantity and position corresponding to those of the locking holes 156, and a through slot 232 formed on the front side thereof. The first outer cover 23 can cover the range of the power connection rod 21 by the open inner side and allows the first connection line 22 to extend from the through slot 232 and a locking member 233 to pass through the hole column 231 from the outside and then lock with the locking hole 156, so that the first outer cover 23 can be securely mounted on a side of the electric control box 15 to cover the power connection rods 21.

In FIGS. 3 and 4, three power connection rods 31 are extended from the top of the power source 11 by locking means, and an inner section of each power connection rod 31 inside the power source 11 is electrically coupled to an electrical connection element (not shown in the figure), and a protruding outer section is exposed from the power source 11, and a protruding edge 32 is formed around the periphery of the area where the three power connection rods 31 are arranged, and the protruding edge 32 has two locking holes 321 downwardly formed at two positons thereof respectively, and a sleeve hole 223 formed at the other end of the aforementioned first connection line 22 can be sheathed on the respective power connection rod 31 in a one-to-one correspondence, and a nut 224 is provided for screwing and connecting the power connection rod 41, and till the sleeve hole 223 is locked securely, the electric power is further conducted to the power source 11. There is a second outer cover 33 with a contour corresponding to the protruding edge 32, and a marginal wall 331 is formed inside the second outer cover 33 for a partition purpose, and a through slot 332 is formed on the front side of the second outer cover 33, and a hole column 333 is formed on the rear side of the second outer cover 33 and disposed at a position corresponding to the locking hole 321, and the second outer cover 33 can cover the protruding edge 32 from top to bottom, so that the marginal wall 331 can partition the power connection rods 31 to prevent contacts, and the first connection line 22 is passed out from the through slot 332, and a locking member 334 is passed through the hole column 333 from top to bottom and then locked with the locking hole 321, so that the second outer cover 33 is mounted securely onto the power source 11 to cover the power connection rods 31.

In FIGS. 3 and 4, one waterproof power connection rod 41 and one waterproof connecting rod 42 are protruded from the front side of the electric control box 15, and t a sleeve hole 431 formed at one of the ends of a second connection line 43 is sheathed on the power connection rod 41, and then a nut 432 is provided for screwing and connecting the power connection rod 41, and till the sleeve hole 431 is locked securely, the sleeve hole 433 formed at the other end of the second connection line 43 is provided for coupling a positive electrode of the electric power, that is, the sleeve hole 433 of the second connection line 43 is coupled to the positive electrode of a car battery or an additional battery to conduct the electric power into the electric control box 15, so that the electric control box 15 can sense the amount of power and display the amount of power on the display panel 151. The connecting rod 42 is provided for locking and coupling one of the ends of an induction line 51, and the other end of the induction line 51 is directly locked and coupled to a protruding connecting rod 34 formed on the power source 11, and an inner end of the connecting rod 34 is coupled to a temperature sensor (not shown in the figure) and penetrated deeply into the power source 11 for sensing the temperature, and the sensed temperature data are transmitted through the induction line 51 into the electric control box 15 and then displayed on the display panel 151 after computation. In addition, one power connection rod 35 is protruded and extended from the front side of the power source 11 and a sleeve hole 611 formed at one of the ends of a third connection line 61 is sheathed on the power connection rod 35, and then a nut 612 is provided for screwing and coupling the power connection rod 35. Till the sleeve hole 611 is locked securely, a sleeve hole 613 formed at the other end of the third connection line 61 is sheathed on a negative electrode of an electric power of a car such as the negative electrode of the car battery to serve a spare for grounding.

Figure 5:
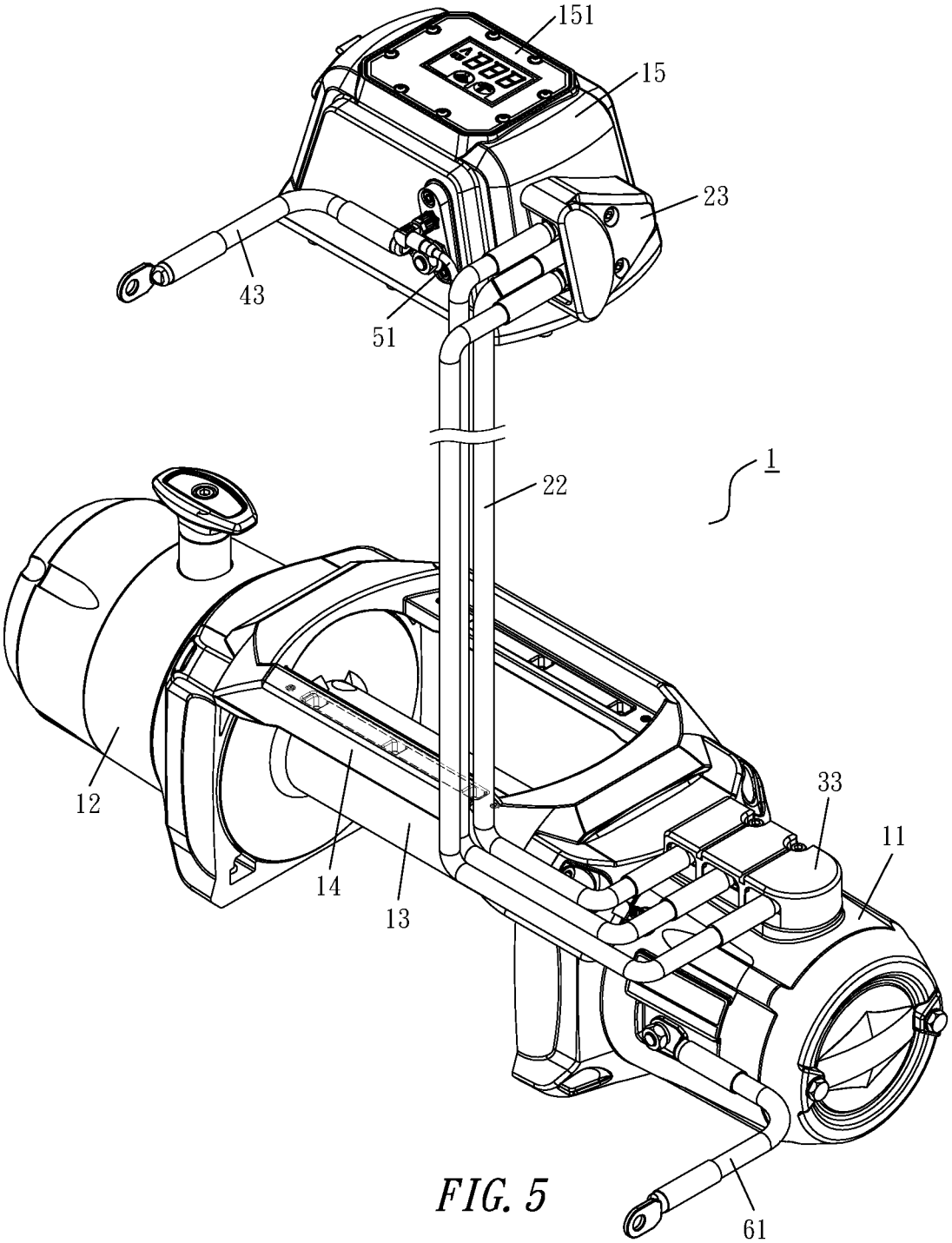
FIG. 5 is a perspective view of the present invention without showing an electric control box and a winch host.

The key improvement made by the present invention resides on that the first connection line 22 and the induction line 51 are connected outside the electric control box 15 and the power source 11, so that the electric control box 15 is not necessarily fixed to the power source 11. As long as the first connection line 22, the second connection line 43 and the induction line 51 with an appropriate length are selected, the installation position of the electric control box 15 can be changed to a different place while maintaining the effect of connecting and using the first connection line 22, the second connection line 43 and the induction line 51 conveniently. In FIG. 5, a user can remove the first outer cover 23 and the second outer cover 33 first, and loosen the nut 222, 224 to remove the first connection line 22. In the meantime, the induction lines 51 at both ends are loosened and removed, so that the electric control box 15 and the power source 11 are no longer connected, and the user can further loosen the plurality of locking members 155 to remove the electric control box 15 from the support frame 14, and then the electric control box 15 can be installed at a different position for use. The other key improvement made by the present invention resides on that the junction of the first connection line 22 and the electric control box 15 and the junction of the first connection line 22 and the power source 11 are covered by the first outer cover 23 and the second outer cover 33 respectively, so that both water resistance and safety are ensured.

Figure 6:
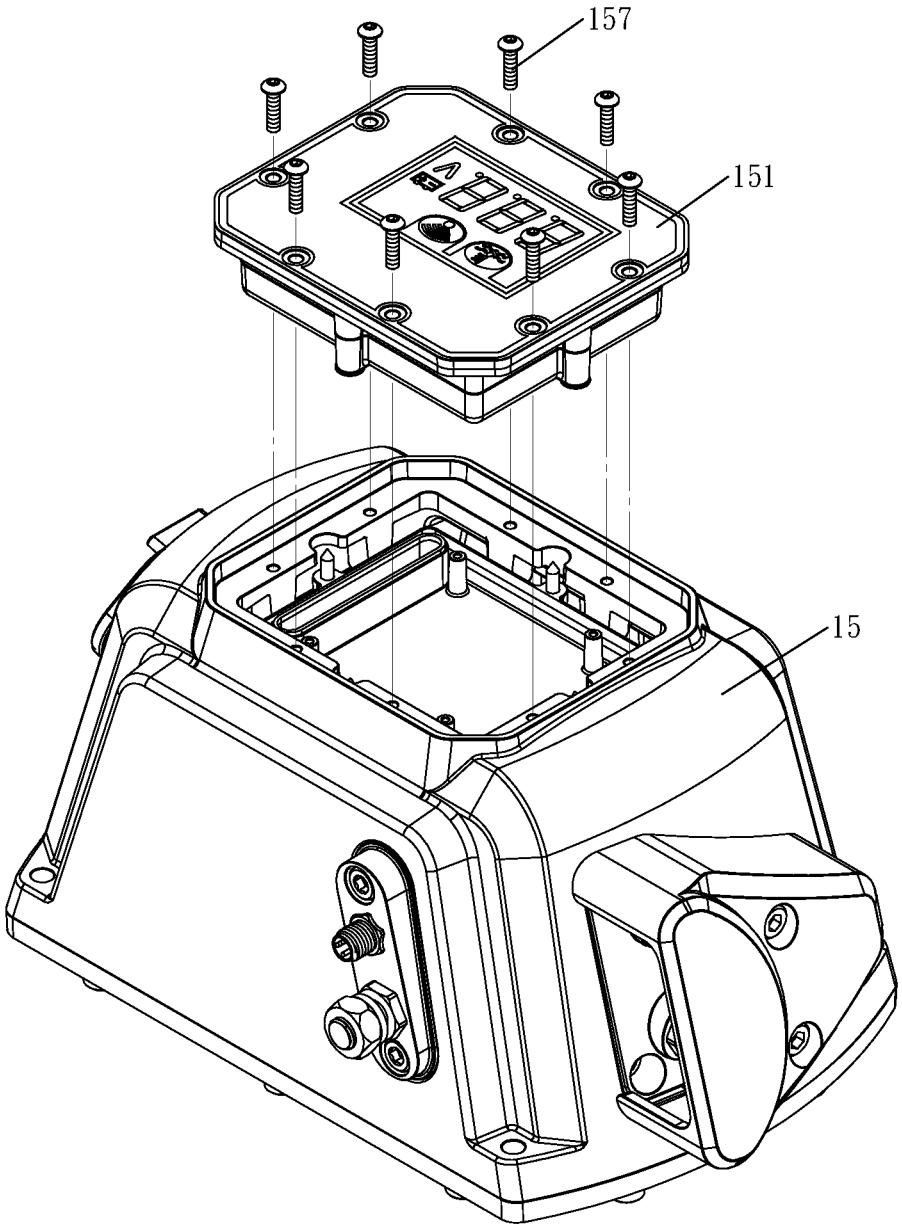
FIG. 6 is a perspective view of the present invention, without showing a display panel and an electric control box.
Figure 7A:
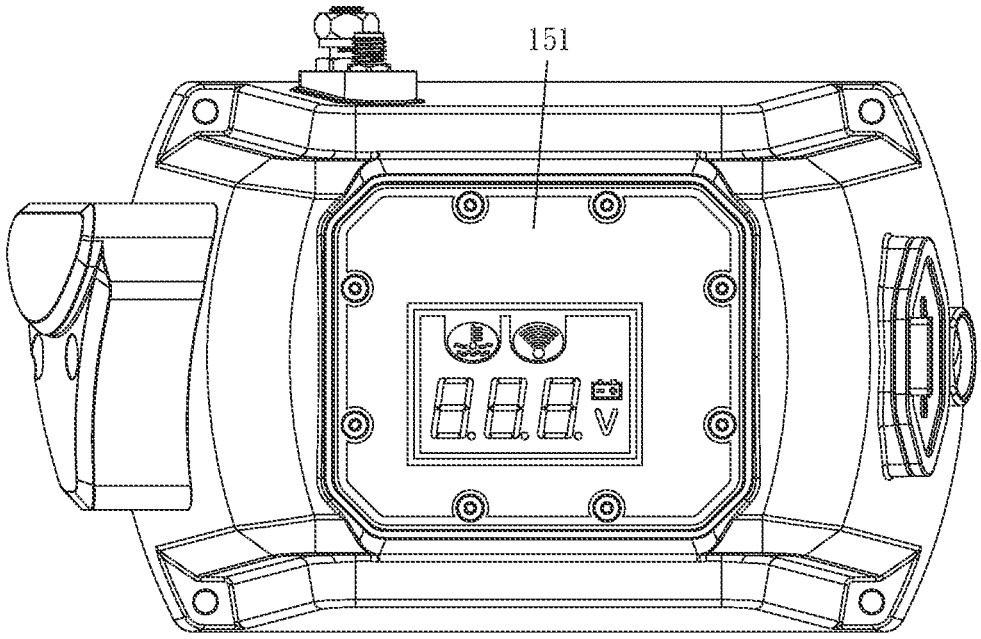
FIGS. 7(*a*) and 7(*b*) are top views of a display panel of the present invention that is adjusted to maintain a correct viewing angle.
Figure 7B:
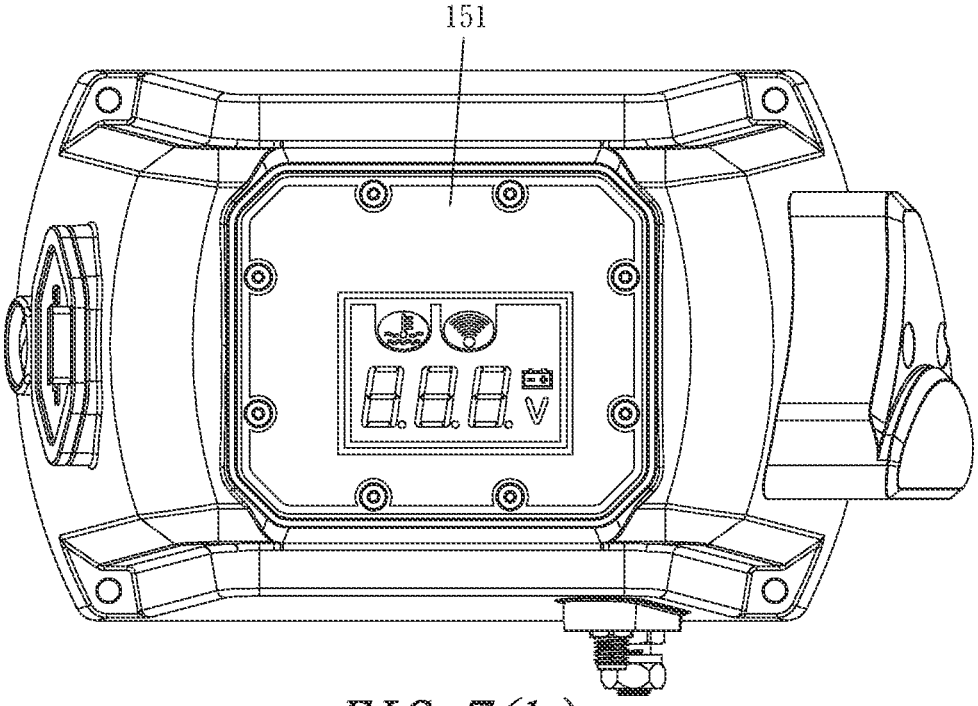

Besides the electric control box 15 can be removed from the support frame 14 to facilitate its installation at a different position, the viewing angle of the display panel 151 of the electric control box 15 can be changed as shown in FIG. 6, and the display panel 151 can be locked and connected to the electric control box 15 by a plurality of locking members 157, so that after the plurality of locking members 157 are removed and the display panel 151 is pulled up, the display panel 151 can be rotated horizontally by 180°, and then put inside the top of the electric control box 15, and finally locked securely again by the plurality of locking members 157 as shown in FIGS. 7(*a*) and 7(*b*), and when the electric control box 15 is upside down when being installed at a different position, the display panel 151 can still be adjusted to maintain a correct viewing angle.

Figure 8:
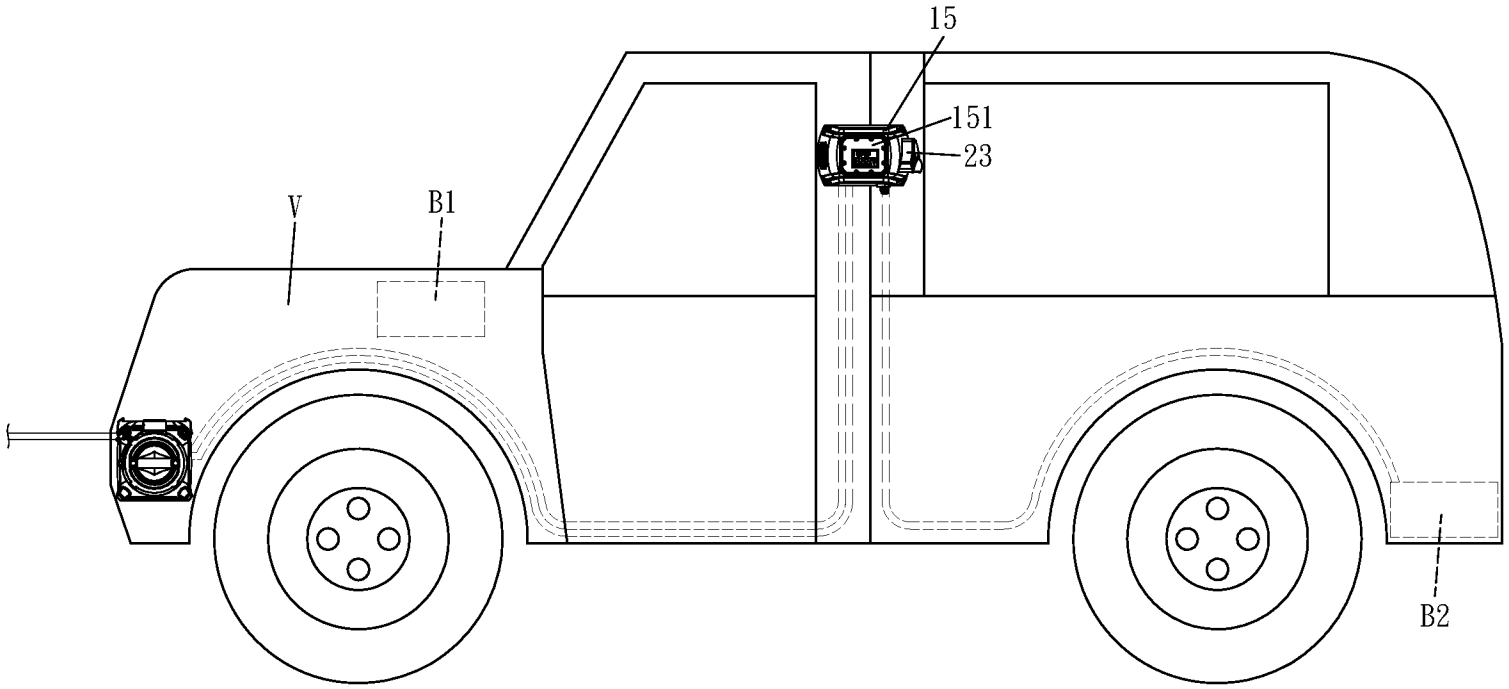
FIG. 8 is a first schematic view of the present invention showing that the electric control box and the winch host are removed and then installed to a car.
Figure 9:
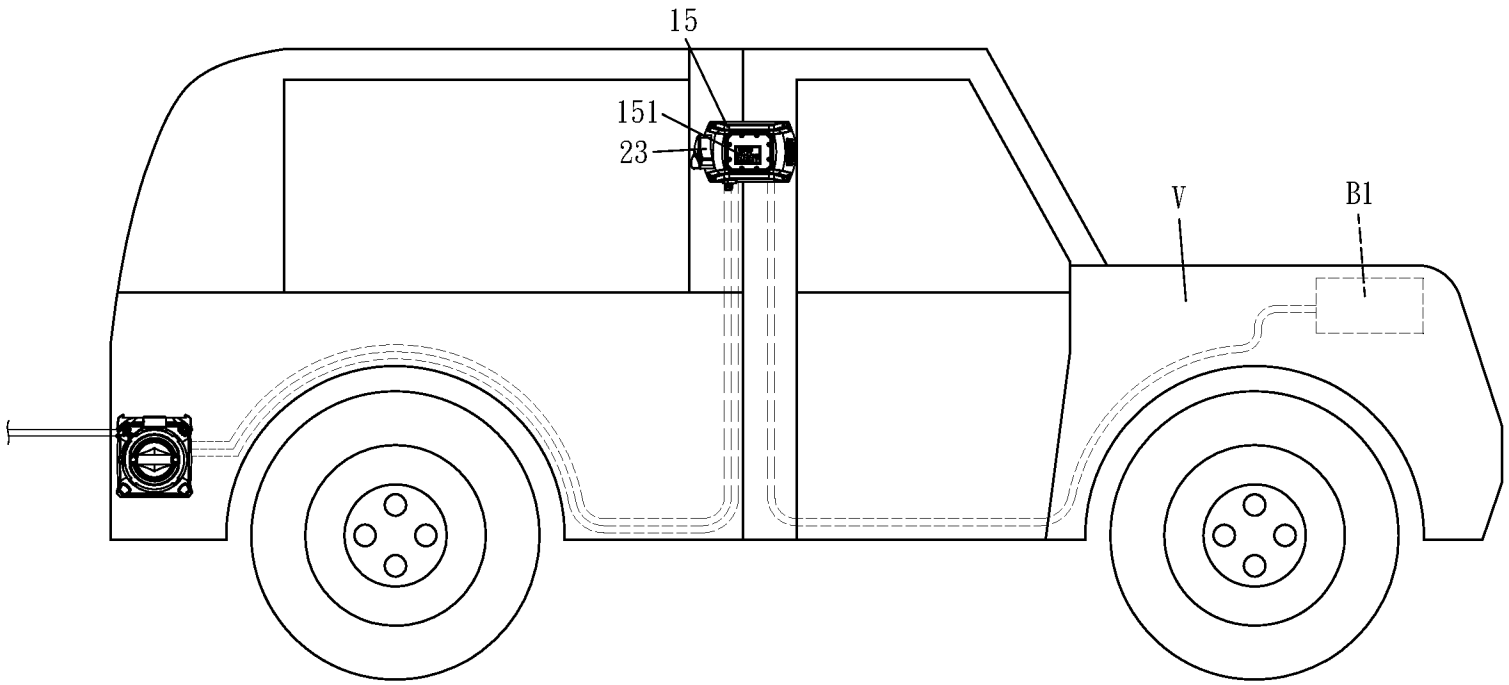
FIG. 9 is a second schematic view of the present invention showing that the electric control box and the winch host are removed and then installed to a car

After the electric control box 15 is removed from the support frame 14, the electric control box can be installed at a different position for use as shown in FIG. 8, and the user can lock the electric control box 15 onto an external surface of a car body of a car V to allow users to watch the display panel 151 horizontally and the winch host is maintained at the bottom of the front of the car V, and then a first connection line 22 and an induction line 51 with an appropriate length are selected, and the sleeve holes 221, 223 formed at both ends of the first connection line 22 are sheathed on the power connection rods 21, 31 again respectively, and then a nut 222, 224 is used for a secured connection. In the meantime, both ends of the induction line 51 are coupled securely with the two connecting rods 42, 34 to achieve a connection between the electric control box 15 and the power source 11. If the user chooses to supply power to the power winch 1 by the rear-end additional battery B2 instead of the battery B1 of the car installed, then the user must select a second connection line 43 with an appropriate length to conduct the electric control box 15 and the additional battery B2, or as shown in FIG. 9, the user locks the electric control box 15 onto the external surface of the car V to allow users to watch the display panel 151 horizontally and the winch host is installed at the bottom of the rear of the car V, and then the first connection line 22 and the induction line 51 with an appropriate length are selected, and the sleeve holes 221, 223 at both ends of the first connection line 22 are sheathed on the power connection rods 21, 31 respectively, and then the nuts 222, 224 are used for a secured connection. In the meantime, both ends of the induction line 51 are locked and coupled to the two connecting rods 42, 34 again respectively to achieve the connection between the electric control box 15 and the power source 11. If the user chooses to supply power to the power winch by the car battery B1 of the car, then the user must select the second connection line 43 with an appropriate length to conduct the electric control box 15 and the car battery B1. Regardless of the arrangements illustrated in FIG. 8 or FIG. 9, the operator simply stands next to the car and uses the remote control to control the power winch 1 by the electric control box 15 to release or retract the rope, while watching the data dynamically shown on the display panel 151 of the electric control box 15 to know about the situation of the power winch 1. When the electric control box 15 and the power source 11 are separated by a considerable distance during use, the third connection line 61 with an appropriate (or increased) length can be selected to facilitate the connection of the power connection rod 35 with the negative electrode of the electric power to serve as a backup for grounding.

As disclosed above, the present invention mainly installs the first connection line 22, the induction line 51, the second connection line 43 and the third connection line 61 outside the electric control box 15 and the power source 11 to facilitate a quick separation of the electric control box 15 and the power source 11, and after the installation positions of the electric control box 15 and the power source 11 are switched, the two can be reconnected quickly, so that the power winch 1 provides a convenient way of changing the installation positions of the electric control box 15 and the power source 11 and broadens the scope of applicability. In the meantime, the junction of the first connection line 22 and the electric control box 15 and the junction of the first connection line 22 and the power source 11 are covered by the first outer cover 23 and the second outer cover 33 respectively, so that both water resistance and safety are ensured.

In summation of the description above, the power winch with changeable connection position in accordance with the present invention is novel and can really achieve the expected creative purpose. Apparently, the invention complies with patent application requirements, and is thus duly filed for patent application.

What is claimed is:

1. A power winch with changeable connection position, comprising:

a power source capable of driving a rope wheel to rotate the power winch in a forward rotation or a reverse rotation to release or retract a rope after the power source outputs a power transmission to a reduction gear; and an electric control box electrically coupled to the power source for controlling the ON/OFF of the power source and the rotating direction for an output force of the power source; characterized in that the electric control box comprises a plurality of waterproof power connection rods protruding from a side thereof, and an inner section of the power connection rods inside the electric control box is electrically coupled to an external electric power, and a protruding outer section of the power connection rods is exposed from a side of the electric control box;

a plurality of first connection lines, with a quantity equal to the quantity of the power connection rods, and an end of the first connection line is coupled to the respective power connection rod;

a plurality of waterproof protruding power connection rods formed on the power source and having a quantity equal to the quantity of the first connection lines, and an inner section of the power connection rod of the power source being electrically coupled to the interior of the power source, and an outer protruding section of the power source being exposed from the power source, and the other end of the first connection line being coupled to the respective power connection rod of the power source.

2. The power winch with changeable connection position as claimed in claim 1, wherein the power connection rods protruding from a side of the electric control box come with a quantity of three.

3. The power winch with changeable connection position as claimed in claim 1, wherein the electric control box comprises a plurality of locking holes formed on a side thereof; a first outer cover, having an open inner side, a plurality of hole columns with quantity and position corresponding to those of the locking hole, and a through slot formed on the front side of the first outer cover, and the first outer cover covers the range of the power connection rods by the open inner side, and the first connection line is extended out from the through slot, and then a locking member is passed through the hole column from the outside and then locked to the locking hole, and the first outer cover is mounted onto a side of the electric control box to cover the power connection rods.

4. The power winch with changeable connection position as claimed in claim 1, wherein the power connection rods of the power source are arranged and partitioned to form a protruding edge around the power connection rods, and the protruding edge has two locking holes downwardly formed thereon; and the power winch further comprises a second outer cover configured to be corresponsive to the protruding edge and having a marginal wall formed inside the second outer cover and provided for partition, a through slot formed on the front side of the second outer cover, a hole column formed on a rear side of the second outer cover and configured to be corresponsive to the locking hole of the protruding edge and the second outer cover covers the protruding edge from top to bottom, and the marginal wall partitions the power connection rods of the power source, and the first connection line is passed out from the through slot, and a locking member is passed through the hole column of the second outer cover from top to bottom and then locked to the locking hole of the second outer cover, and the second outer cover is mounted onto the power source to cover the power connection rods of the power source.

5. The power winch with changeable connection position as claimed in claim 1, wherein one power connection rod is protruded and extended from the front of the electric control box, and the power winch further has a second connection line with an end coupled to the power connection rod protruded and extended from the front of the electric control box, and the other end of the second connection line is coupled to a positive electrode of the electric power.

6. The power winch with changeable connection position as claimed in claim 1, wherein one connecting rod is protruded and extended from the front of the electric control box, and the power winch further has an induction line with both ends coupled to the connecting rod protruded and extended from the front of the electric control box and the connecting rod protruded and extended from the front side of the power source respectively.

7. The power winch with changeable connection position as claimed in claim 1, wherein one power connection rod is protruded and extended from the front side of the power source, and the power winch further has a third connection line with an end coupled to the power connection rod protruded and extended from the front side of the power source, and the other end of the third connection line is coupled to a negative electrode of the electric power.

* * * * *